US007645350B1

(12) United States Patent
Kecskes et al.

(10) Patent No.: US 7,645,350 B1
(45) Date of Patent: Jan. 12, 2010

(54) HIGH-DENSITY METALLIC GLASS ALLOYS

(75) Inventors: Laszlo J. Kecskes, Havre de Grace, MD (US); Brian T. Edwards, Nottingham, MD (US); Robert H. Woodman, Bel Air, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 8 days.

(21) Appl. No.: 10/828,530

(22) Filed: Apr. 6, 2004

(51) Int. Cl.
*C22C 45/00* (2006.01)

(52) U.S. Cl. ..... 148/561; 148/403; 420/423

(58) Field of Classification Search ..... 148/403, 148/561

See application file for complete search history.

(56) References Cited

U.S. PATENT DOCUMENTS

| | | | | |
|---|---|---|---|---|
| 5,288,344 | A | 2/1994 | Peker et al. | 148/403 |
| 5,618,359 | A | 4/1997 | Lin et al. | 148/561 |
| 5,735,975 | A | 4/1998 | Lin et al. | 148/403 |
| 5,797,443 | A | 8/1998 | Lin et al. | 164/4.1 |
| 6,623,566 | B1 * | 9/2003 | Senkov et al. | 148/121 |
| 7,361,239 | B2 * | 4/2008 | Zahrah et al. | 148/561 |
| 2002/0036034 | A1 * | 3/2002 | Xing et al. | 148/561 |
| 2003/0217790 | A1 * | 11/2003 | Wolter | 148/403 |
| 2006/0081310 | A1 * | 4/2006 | Yokoyama | 148/403 |

OTHER PUBLICATIONS

Gu X., L.Q. Xing, and T.C. Hufnagel, "Glass-Forming Ability and Crystallization of Bulk Metallic Glass $(Hf_xZr_{1-x})_{52.5}Cu_{17.9}Ni_{14.6}Al_{10}Ti_5$," J. Non-Cryst. Sol.,. 311(1):77-82, 2002.

Johnson, W.L., "Bulk Glass-Forming Metallic Alloys: Science and Technology," MRS Bulletin, 24(10):42-56, 1999.

Peker, A., and W.L. Johnson, "A Highly Processable Metallic Glasss: $Zr_{41.2}Ti_{13.8}Cu_{12.5}Ni_{10.0}Be_{22.5}$," Appl. Phys. Lett., 63(17):2342-2344, 1993.

Spaepen, F., "A Microscopic Mechanism for Steady State Inhomogeneous Flow in Metallic Glasses," Acta. Met., 25(4):407-415, 1977.

Subhash, G., R.J. Dowding, and L.J. Kecskes, "Characterization of Uniaxial Compressive Response of Bulk Amorphous Zr-Ti-Cu-Ni-Be Alloy," Mat. Sci. and Eng., A334(1):33-40, 2002.

Xing, L.Q., P. Ochin, M. Harmelin, F. Faudot, and J. Bigot , "Alloys of High Glass-Forming Ability," J. Non-Cryst. Sol., 205-207(2):597-601, 1996.

* cited by examiner

*Primary Examiner*—George Wyszomierski
(74) *Attorney, Agent, or Firm*—Edward L. Stolarun; A. David Spevack

(57) ABSTRACT

A class of high-density bulk metallic glass hafnium alloys, having copper, nickel, aluminum and titanium or niobium as alloying elements is disclosed. This class includes alloys having higher densities and a higher reduced glass-transition temperature than other known metallic glass alloys.

22 Claims, 8 Drawing Sheets

Differential Thermal Analysis Trace

$Hf_{44.5}Cu_{27}Ni_{13.5}Ti_5Al_{10}$ Bulk Metallic Glass

X-ray Diffraction Pattern

$Hf_{44.5}Cu_{27}Ni_{13.5}Ti_5Al_{10}$ Bulk Metallic Glass

Quasi-Static Mechanical Response

$Hf_{44.5}Cu_{27}Ni_{13.5}Ti_5Al_{10}$ Bulk Metallic Glass

Differential Thermal Analysis Trace

$Hf_{44.5}Cu_{27}Ni_{13.5}Nb_5Al_{10}$ Bulk Metallic Glass

Differential Thermal Analysis Trace

$Hf_{44.5}Cu_{27}Ni_{13.5}Nb_5Al_{10}$ Bulk Metallic Glass

HIGH-DENSITY METALLIC GLASS ALLOYS

GOVERNMENT INTEREST

The invention described herein may be manufactured, used, and licensed by or for the United States Government.

BACKGROUND

1. Technical Field

The present disclosure relates generally to metallic glass alloys, more particularly to at least quinary alloys.

2. Description of the Related Art

Metallic glass alloys (MGAs), or metallic glasses, are amorphous metals and have been reported as existing in thin ribbon form since as early as the 1950s. Metallic glasses differ from conventional metals in that they lack an ordered, crystalline structure. The atoms in the amorphous structure are randomly arranged, like in a liquid, rather than sitting on a repeatable, orderly lattice. This lack of crystalline structure means that metallic glasses also lack crystalline defects, such as grain boundaries and dislocations. Without these defects metallic glasses exhibit improved mechanical properties, magnetic behavior, and corrosion resistance.

Because the equilibrium structure for a metal alloy is always crystalline, amorphous metals can only be produced by rapid cooling from the liquid state. Until recently, the cooling rates required were on the order of $10^5$-$10^6$ K/s, which limits the thickness of a fully amorphous alloy to fractions of a millimeter. The resulting ribbons and wires are used extensively as transformer cores and magnetic sensors, but the small dimensions limit the structural applications of the material.

The recent development of bulk metallic glasses has introduced many new uses of these materials in structural applications. These alloys require cooling rates of only 1-100 K/s, so fully amorphous castings up to a centimeter thick can be manufactured using conventional casting methods. Metallic glass alloys are used in golf clubs, fishing rods, car bumpers, aircraft skins, artificial joints, dies, armor-piercing projectiles, engine parts, and cutting tools.

The recent development of Zr-based MGAs (compositions with much lower critical cooling rates and thus castable in thicker sections) are interesting candidates for structural material applications because of the increased thickness (Johnson, W. L., "Bulk Glass-Forming Metallic Alloys: Science and Technology," *MRS Bulletin,* 24(10):42-56, 1999). Specifically, these MGAs generally possess very high elastic strain limits (2 to 3%) and therefore very high yield strengths (about 1.6 GPa). Beyond their elastic limits, however, MGAs do not strain harden, and plastic deformation is immediately localized into shear bands. Shear bands thus serve as a MGA's sole mechanism of plastic flow, under quasi-static as well as dynamic stress loads. The localization is generally modeled as resulting from a reduction in local viscosity, associated with an increase in "free volume" as atoms move within the amorphous structure, but there is not a universally agreed-upon explanation for this behavior (Spaepen, F., "A Microscopic Mechanism for Steady State Inhomogeneous Flow in Metallic Glasses," *Acta. Met.,* 25(4):407-415, 1977). At higher strain rates, the additional thermal-softening component leads to an earlier failure along one of the first shear bands, reducing the net accumulation of the plastic deformation (Subhash, G., R. J. Dowding, and L. J. Kecskes, "Characterization of Uniaxial Compressive Response of Bulk Amorphous Zr—Ti—Cu—Ni—Be Alloy," *Mat. Sci. and Eng.,* A334(1):33-40, 2002).

Unfortunately, most Zr-based MGAs have relatively low densities of less than 7 g/cm$^3$. Coupled with typical failure strengths of 1.6 GPa, their use disallows compressive load-bearing applications which require higher densities and higher strengths, and without the customary plastic flow and deformation.

SUMMARY

The present disclosure provides metallic glass alloys (MGA)s which can be generally represented by the formula $X_aCu_bNi_cAl_dY_e$, wherein X includes at least one transition metal element selected from periodic table Group IV, Y includes at least one element selected from Group IV transition metal elements, wherein X is not equal to Y, Group VA, VIII, IVB, and VB, wherein a+b+c+d+e=100% (atomic percent), and a is less than 45, preferably 35<a<45, 15<b<35, 5<c<25, 0<d<20, and 0<e<15. Exemplary alloys in this composition range can be formed into an amorphous, glassy structure at moderate cooling rates of less than 1,000 K/s.

One aspect of the disclosure, among others, provides exemplary glass metallic alloys having a density of greater than 7 g/cm$^3$. Another aspect provides representative alloys which have one or more characteristic features of known metallic glasses including: a distinct glass transition, a supercooled liquid region, and a devitrication sequence that results in the loss of the disordered structure. Moreover, alloys in other aspects exhibit failure in a quasi-brittle manner, wherein an elastic stress response is followed by a small plastic deformation region, and subsequent catastrophic failure in a narrow, localized region of the material.

Still another aspect of the disclosure provides glass metallic alloys having a strength to failure value of approximately 2 GPa. The general sequence of this failure is retained from quasi-static- to high-strain rates of 0.0001/s to 10,000/s.

In other aspects of the disclosure, the exemplary alloys may be formed into a bulk solid having a disordered atomic structure, i.e., metallic glass, by any one of several techniques such as arc melting, copper mold casting, suction casting, melt spinning, splat quenching, injection die casting, extrusion, or other methods. The metallic glass compositions can be shaped into articles, for example projectiles, bullets, spheres, pellets, sheets, bars, ingots, plates, and the like.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Exemplary glass metallic alloys of the present disclosure can be generally represented by the formula $X_aCu_bNi_cAl_dY_e$, wherein X comprises one or more elements selected from Group IV transition metal elements, Y comprises at least one element selected from Group IV transition metal elements VA, VIII, IVB, and VB, wherein a+b+c+d+e=100% (atomic percent), and a is less than 45, preferably 35<a<45, 15<b<35, 5<c<25, 0=d<20, and 0<e<15. Group IV transition metal elements include Ti, Zr, Hf, and Unq (element 104). Group VA includes V, Nb, Ta, Unp (element 105). Group VIII includes Fe, Co, Ni, Ru, Rh, Pd, Os, Ir, and Pt. Group VB includes N, P, As, Sb, and Bi. Group VIB includes C, Si, Ge, Sn, and Pb.

One embodiment, among others, provides glass metallic alloys of the general formula above wherein the alloys have a density of at least 7 g/cm$^3$ while optionally retaining at least one characteristic of known MGAs including but not limited to: a distinct glass transition, a supercooled liquid region, and a devitrication sequence that results in the loss of the disordered structure.

Embodiments of the present disclosure combine a density of at least 7 g/cm$^3$ with a reduced glass transition temperature, for example a glass transition which is predicated on a special combination of its three principal constituents (Hf, Cu, and Ni). This combination was established through experimentation with the Hf—Cu—Ni ternary system.

Figure 1:
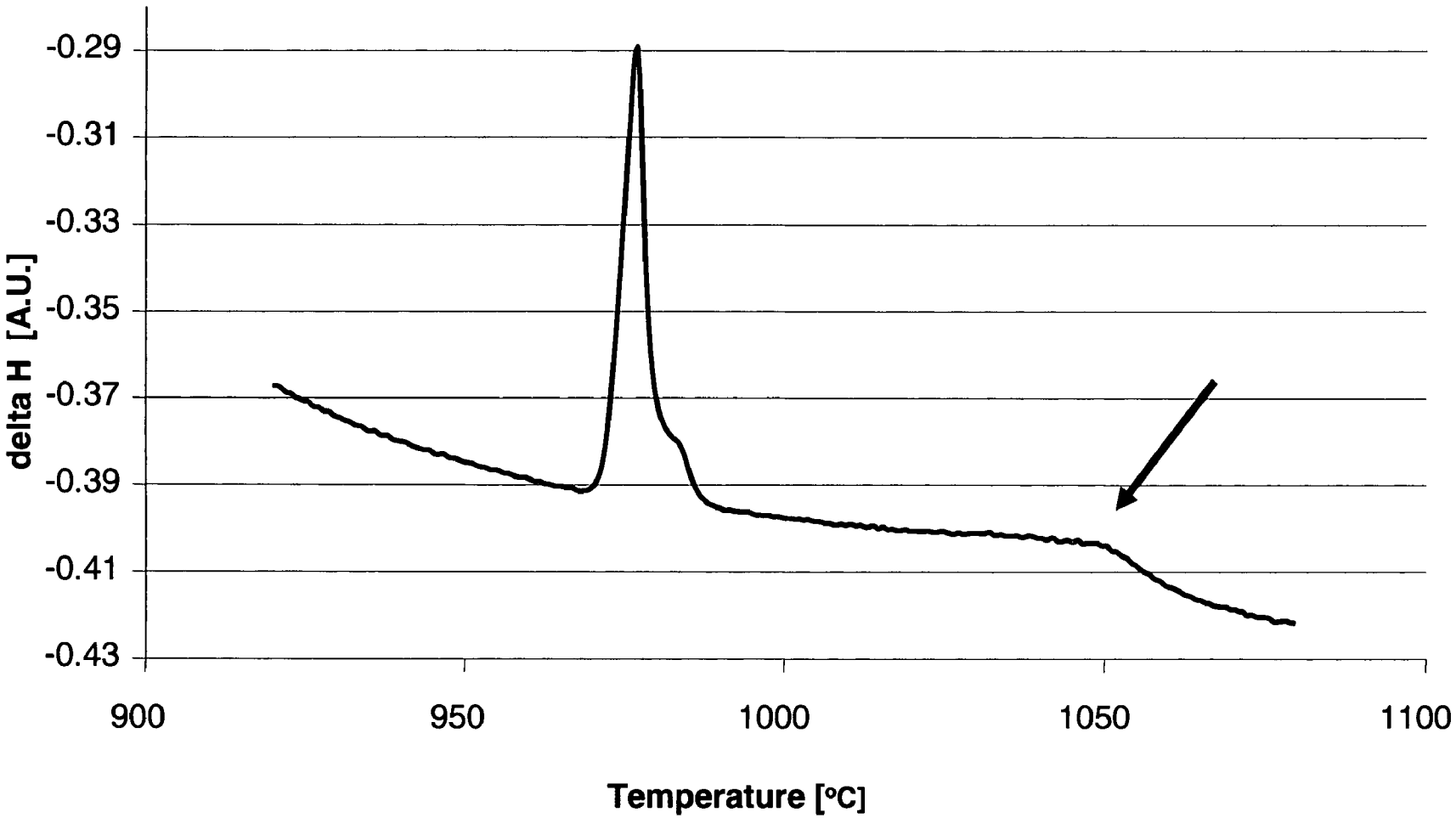
FIG. 1 is a differential thermal analysis trace for comparative bulk metallic glass alloy of the formula $Hf_{52.5}Cu_{17.9}Ni_{14.6}Ti_5Al_{10}$, showing the solidus and liquidus of the alloy.

Despite the high degree of similarity between Hf and Zr, the direct substitution of Hf for Zr into Zr-based MGAs results in a significant degradation of the glass-forming ability of the material. It has been discovered that although Zr-based MGA may be a eutectic or near-eutectic composition, the equivalent Hf-based MGA is not. Such a special composition melts congruently, with a sharp endothermic peak in its differential thermal analysis trace. That is, it behaves as a single-phase solid transforming into a liquid at one temperature. In contrast, an off-eutectic composition exhibits a wide endothermic peak. FIG. 1 illustrates the incongruent melting behavior of the Hf-based equivalent of a Zr-based MGA, $Hf_{52.5}Cu_{17.9}Ni_{14.6}Al_{10}$. The arrow indicates the trailing end of the melting peak, implying the presence of a phase that does not melt until higher temperatures.

Consequently, it was necessary to determine the precise position of this special composition point in the Hf—Cu—Ni ternary system. It has been discovered that the position of this composition point is not the same as that found in the Zr—Cu—Ni system.

The components of an exemplary MGA can be formed into a master-alloy ingot by inert-gas tungsten-arc melting or by other common metallurgical techniques (e.g., vacuum-induction melting, skull melting, etc.). The master alloy may be formed into a MGA having an amorphous structure by methods including, but not limited to, copper mold casting, arc-melt quenching on a water-cooled copper plate, water or oil quenching, melt spinning, planar flow casting, or extrusion. The MGA thus formed has no long-range order and exhibits a well-defined glass transition with a supercooled liquid region. The required cooling rate to circumvent or suppress crystal formation for the MGA lies between 1 and 1000 K/s depending on exact composition and purity, which makes the alloy suitable for processing in bulk form.

Some embodiments of the alloys presented have a well defined glass transition temperature that occurs at approximately 773 K (500° C.), and liquefy below 1273 K (1000° C.). Hence, in one embodiment the alloys have a reduced glass transition temperature of about (773/1273)=0.61, which serves to indicate that the alloy is fairly easy to cast into the amorphous state. Similar alloys considered to be good MGA formers have reduced glass transitions of 0.55-0.67. The first alloy being presented has a single exothermic crystallization event at about 828 K (555° C.). The difference between the first crystallization event and the glass transition denotes the supercooled liquid region. For this alloy the supercooled liquid region is about 60 K, which is consistent with other MGAs. In some embodiments, the disclosed MGAs include compositions having at least some degree of crystallinity, for example less that about 20% cyrstallinity, more typically less than about 10% crystallinity.

In other embodiments, the alloys exhibit a failure stress of approximately 2 GPa, which is consistent with the shear modulus of MGAs of similar composition. The alloy undergoes about 2% elastic strain before failing, as shown by quasi-static testing. This relatively low strain to failure is a characteristic of monolithic MGAs. The alloys have a Young's modulus of 100 GPa, indicating a large amount of stress required to deform the alloy. The alloys fail by localized shear band formation and propagation, regardless of the strain rate used to deform the alloy.

EXAMPLE 1

Samples of the desired MGA composition of $Hf_{44.5}Cu_{27}Ni_{13.5}Ti_5Al_{10}$ were prepared by arc melting high-purity elemental metals in a purified argon atmosphere, followed by suction casting of the alloy into copper molds. The master alloy composition was prepared by arc melting in an argon atmosphere that was purged of oxygen through a series of evacuations and backfills. All melting was done on a water-cooled OFHC copper plate. The alloy was remelted several times and then suction cast into a copper mold to produce an amorphous rod of three (3) mm diameter and 100-mm length. Density measurements of the ingot material, using Archimedes' Principle, yielded a density of 10.9 g/cm$^3$.

Figure 2:
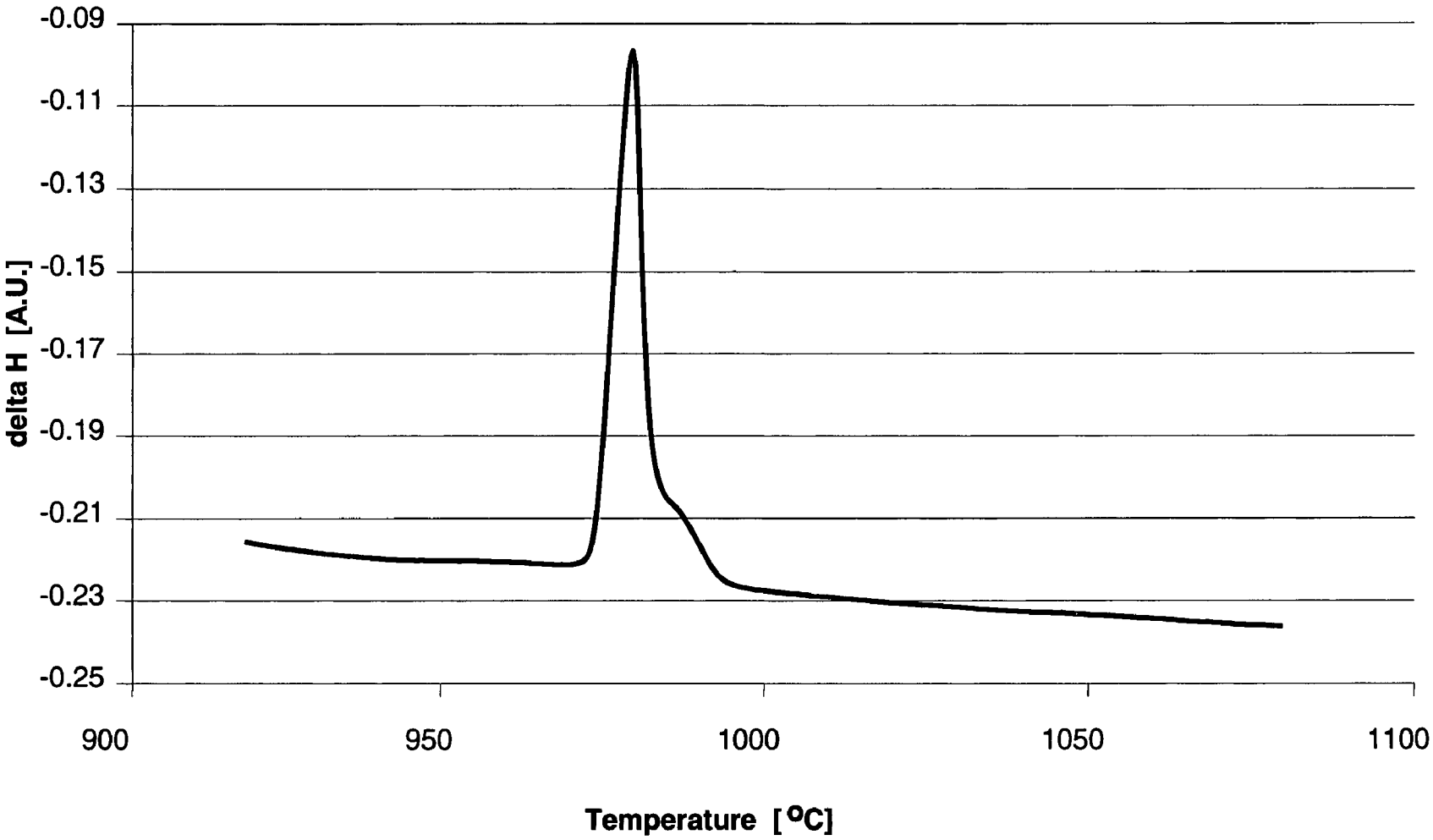
FIG. 2 is a differential thermal analysis trace for an exemplary alloy, showing the solidus and liquidus of the alloy.

FIG. 2 shows a differential thermal analysis trace of the melting behavior of the alloy. Heating was done at a rate of 5 K/min. The plot shows an onset temperature of 1247 K (974° C.), corresponding to the solidus, and the endpoint temperature of 1257 K (984° C.), corresponding to the liquidus. This was the only melting event present for the alloy.

Figure 3:
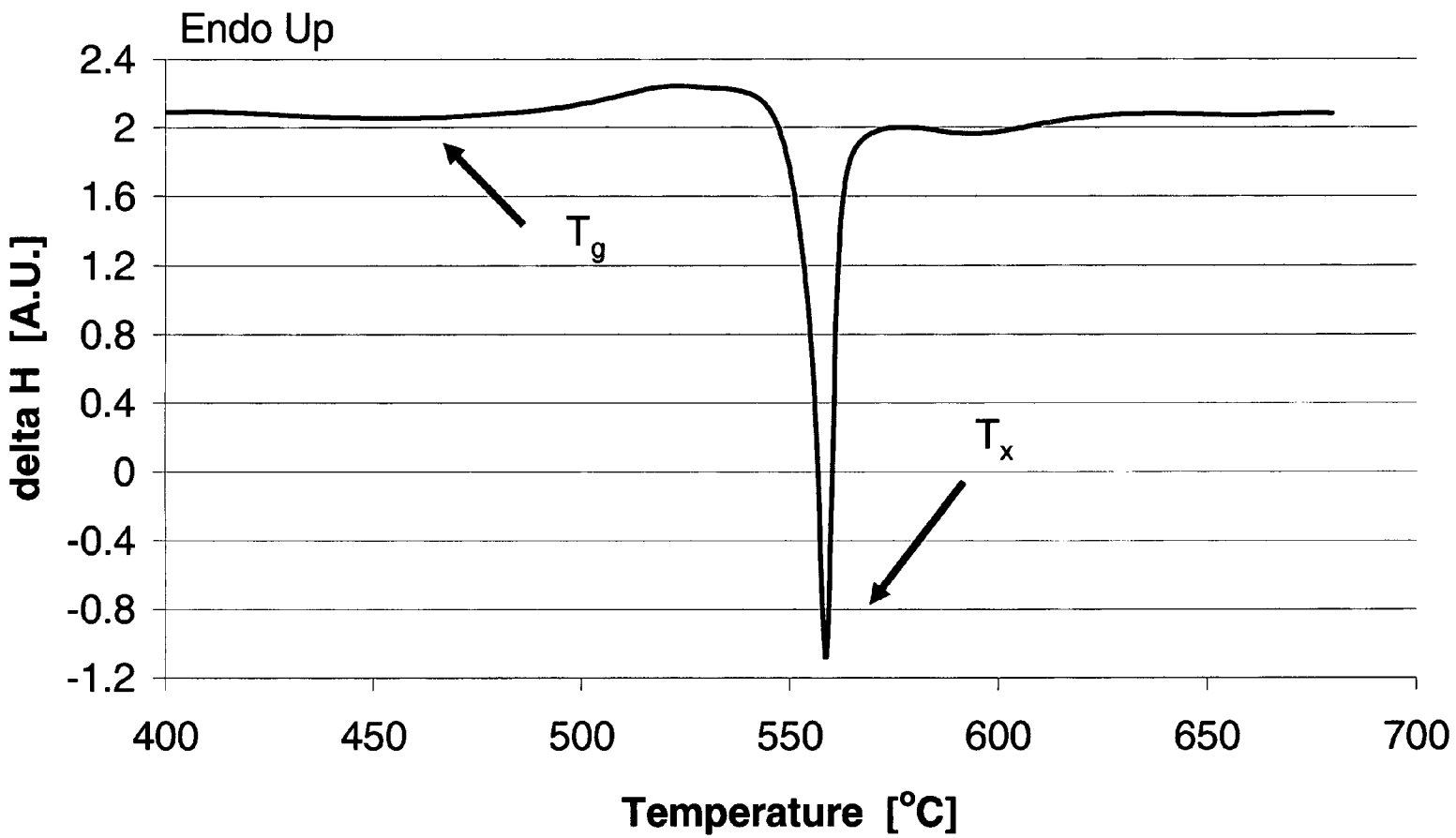
FIG. 3 is a differential thermal analysis trace for an alloy, showing the glass transition and crystallization temperatures, in accordance with a preferred embodiment of the invention.

FIG. 3 shows a differential thermal analysis trace plot of the glass transition, $T_g$, and crystallization, $T_x$, temperatures of the as-cast MGA sample. The glass transition begins at 767 K (494° C.) and is completed at 791 K (518° C.). The onset for crystallization of the glass is at 828 K (555° C.), and there is only one crystallization event for this glass. The supercooled liquid region, the difference between glass transition and crystallization temperatures, is 61 K. The reduced glass transition temperature, denoted as the ratio of glass transition to liquidus (i.e., the high-temperature endpoint of the congruent melting event shown in FIG. 1) is approximately 0.62.

Figure 4:
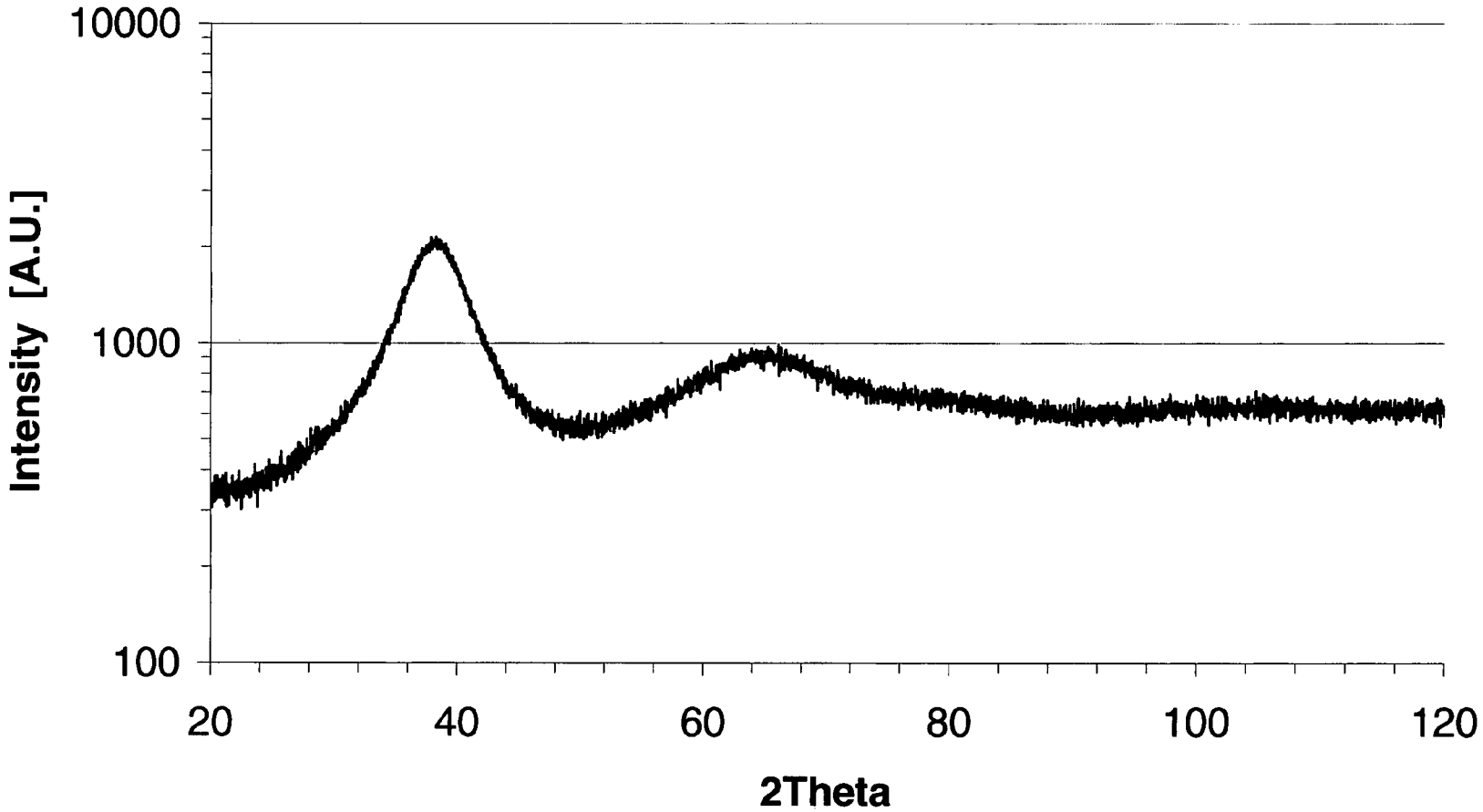
FIG. 4 is a plot of X-ray intensity versus diffraction angle for an exemplary alloy.

FIG. 4 shows a plot of the X-ray diffraction scan of the as-cast sample. The plot shows only two broad, diffuse intensity peaks corresponding to the lack of crystalline order in the material. More importantly, there are no sharp Bragg peaks indicative of crystalline phases, which is further evidence that the sample is in fact amorphous.

Figure 5:
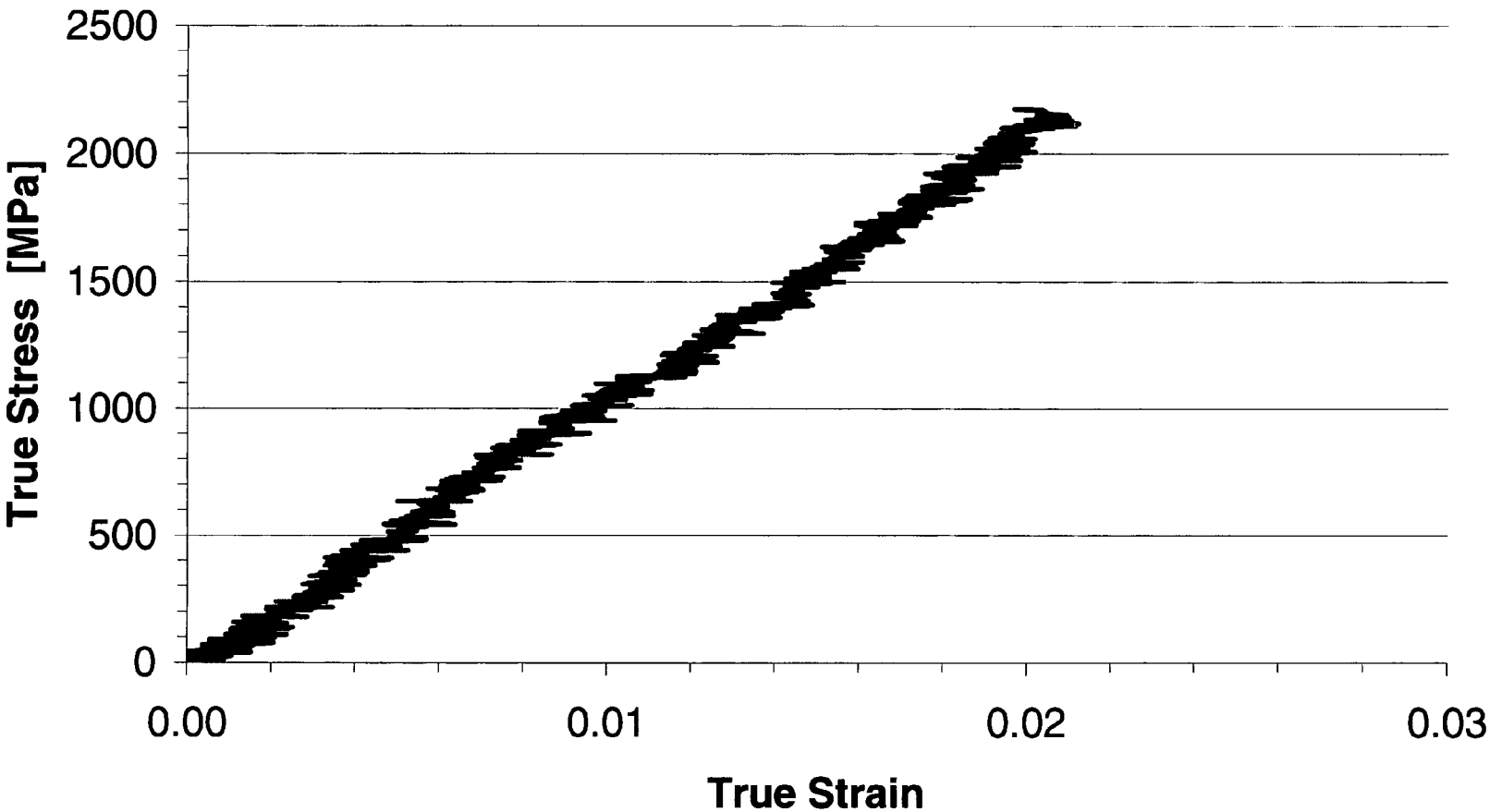
FIG. 5 is a true stress versus true strain plot from a quasi-static strain-rate compression testing of an alloy, performed at a strain rate 0.0001/s, in accordance with a preferred embodiment of the invention.

FIG. 5 shows the mechanical response of the material to quasi-static compression testing. The sample exhibited a failure stress of between 2.1 and 2.2 GPa, which corresponded to a strain to failure of approximately 2%. The behavior was elastic, showing no sign of plastic deformation. The Young's modulus was approximately 100 GPa.

Figure 6:
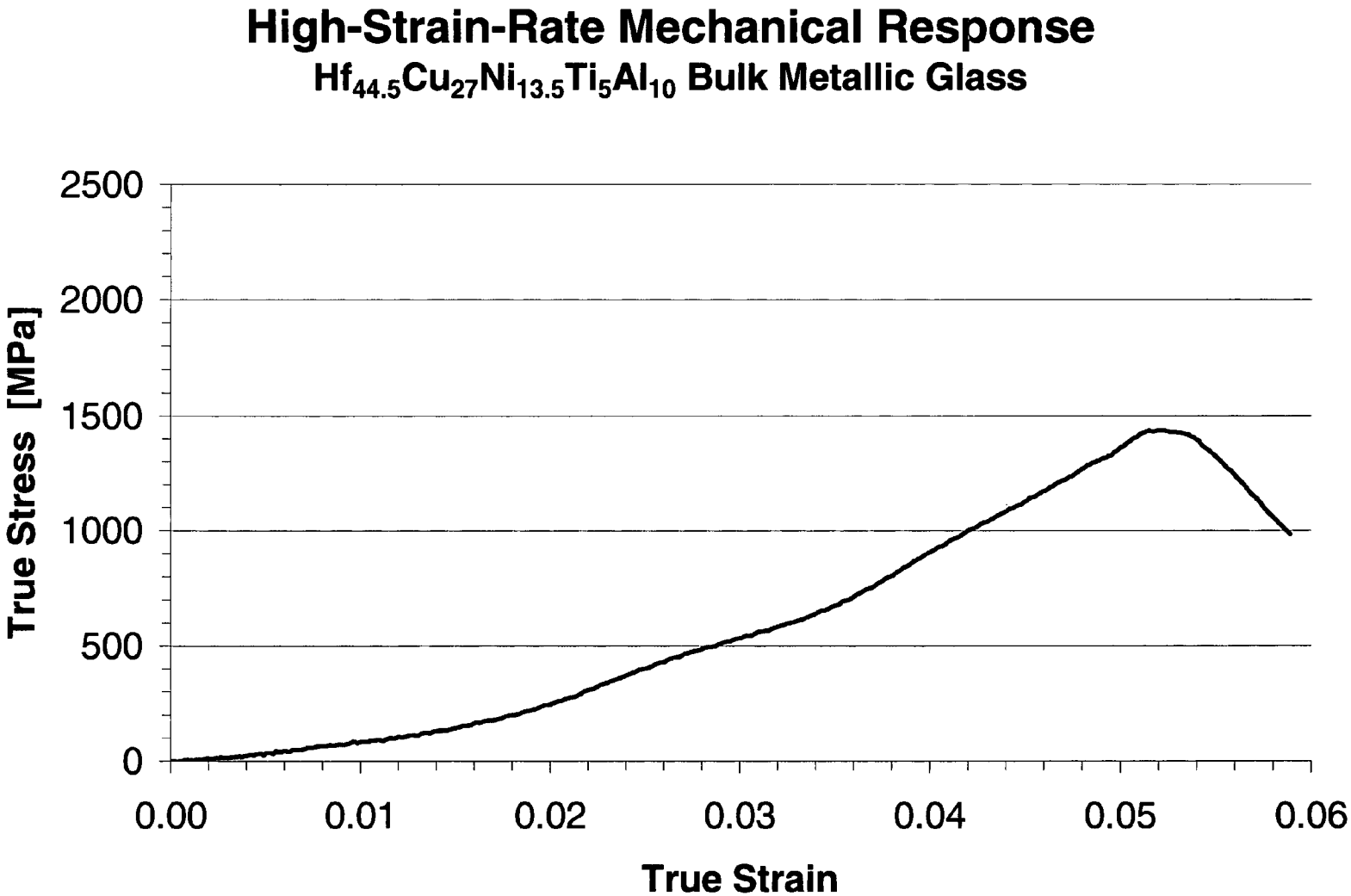
FIG. 6 is a true stress versus true strain plot at a dynamic-strain-rate compression testing of an alloy, performed at a strain rate 2000/s, in accordance with a preferred embodiment of the invention.

FIG. 6 shows the compressive mechanical response of the material when it was subjected to dynamic, split-Hopkinson-pressure-bar testing at a strain rate of 2000 /s. The alloy exhibited a failure stress of about 1.45 GPa. The difference between this failure stress, and that of the quasi-static failure stress was consistent with that observed in other MGAs that are known to undergo localized shear failure.

EXAMPLE 2

Samples of the desired MGA composition of $Hf_{44.5}Cu_{27}Ni_{13.5}Nb_5Al_{10}$ were prepared by arc melting high-purity elemental metals in a purified argon atmosphere, followed by suction casting of the alloy into copper molds. The master alloy composition was prepared by arc melting in an argon atmosphere that was purged of oxygen through a series of evacuations and backfills. All melting was done on a water-cooled OFHC copper plate. The alloy was remelted several times and then suction cast into a copper mold to produce an amorphous rod of three (3) mm diameter and 100-mm length. Density measurements of the ingot material, using Archimedes' Principle, yielded a density of 10.9 g/cm$^3$.

Figure 7:
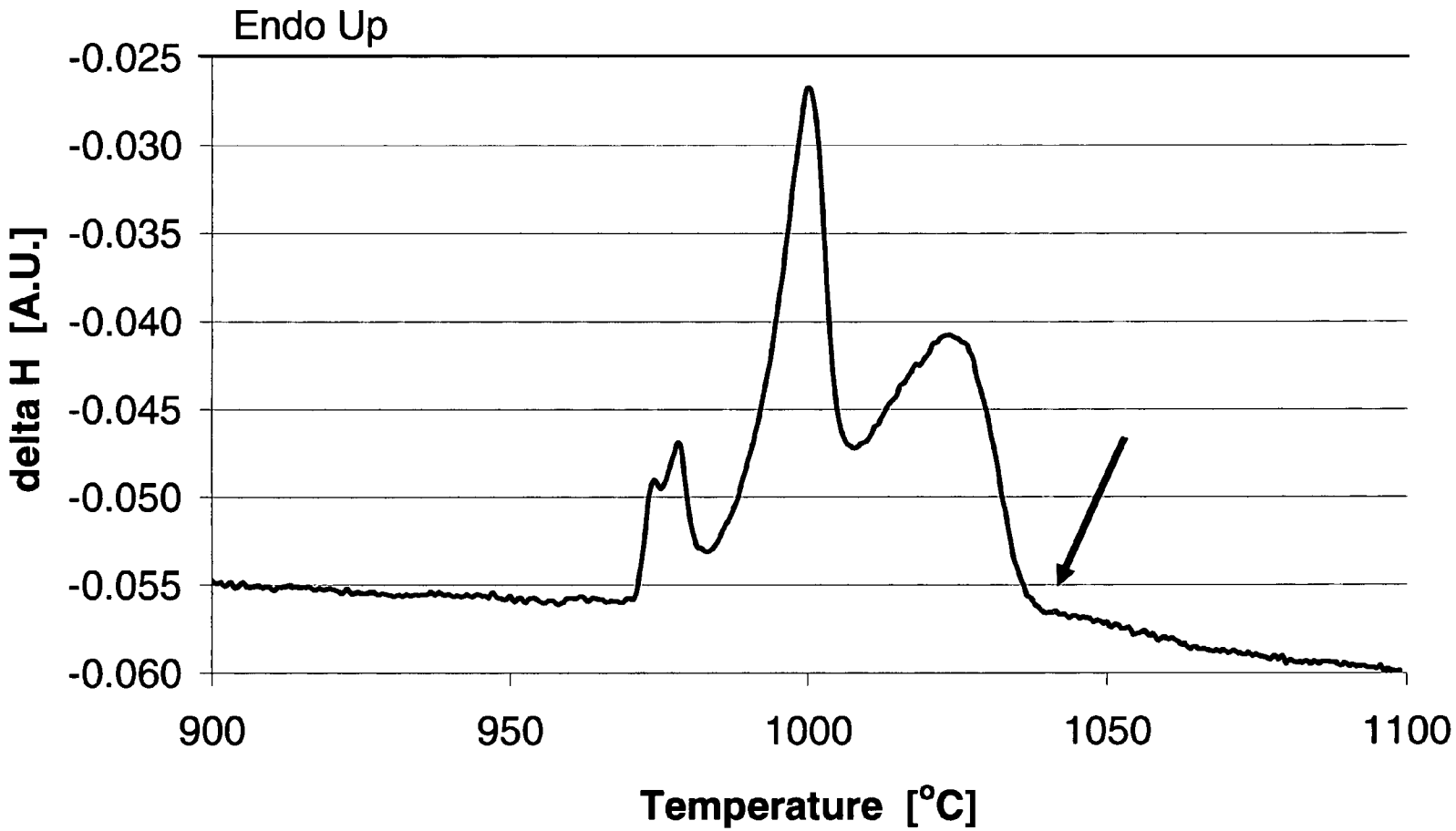
FIG. 7 is the differential thermal analysis trace for an alloy, showing the solidus and liquidus of the alloy, in accordance with a preferred embodiment of the invention.

FIG. 7 shows a differential thermal analysis trace of the melting behavior of the alloy. Heating was done at a rate of 5 K/min. The plot shows an onset temperature of 1244 K (971° C.), corresponding to the solidus, and the endpoint temperature of 1309 K (1036° C.), corresponding to the liquidus. This was the only melting event present for the alloy. Note that the melting behavior of this glass is highly dissimilar from that shown in Example 1. The glass melts incongruently, however, the liquidus is nevertheless lower than that of the substitutionally obtained glass shown in FIG. 1.

Figure 8:
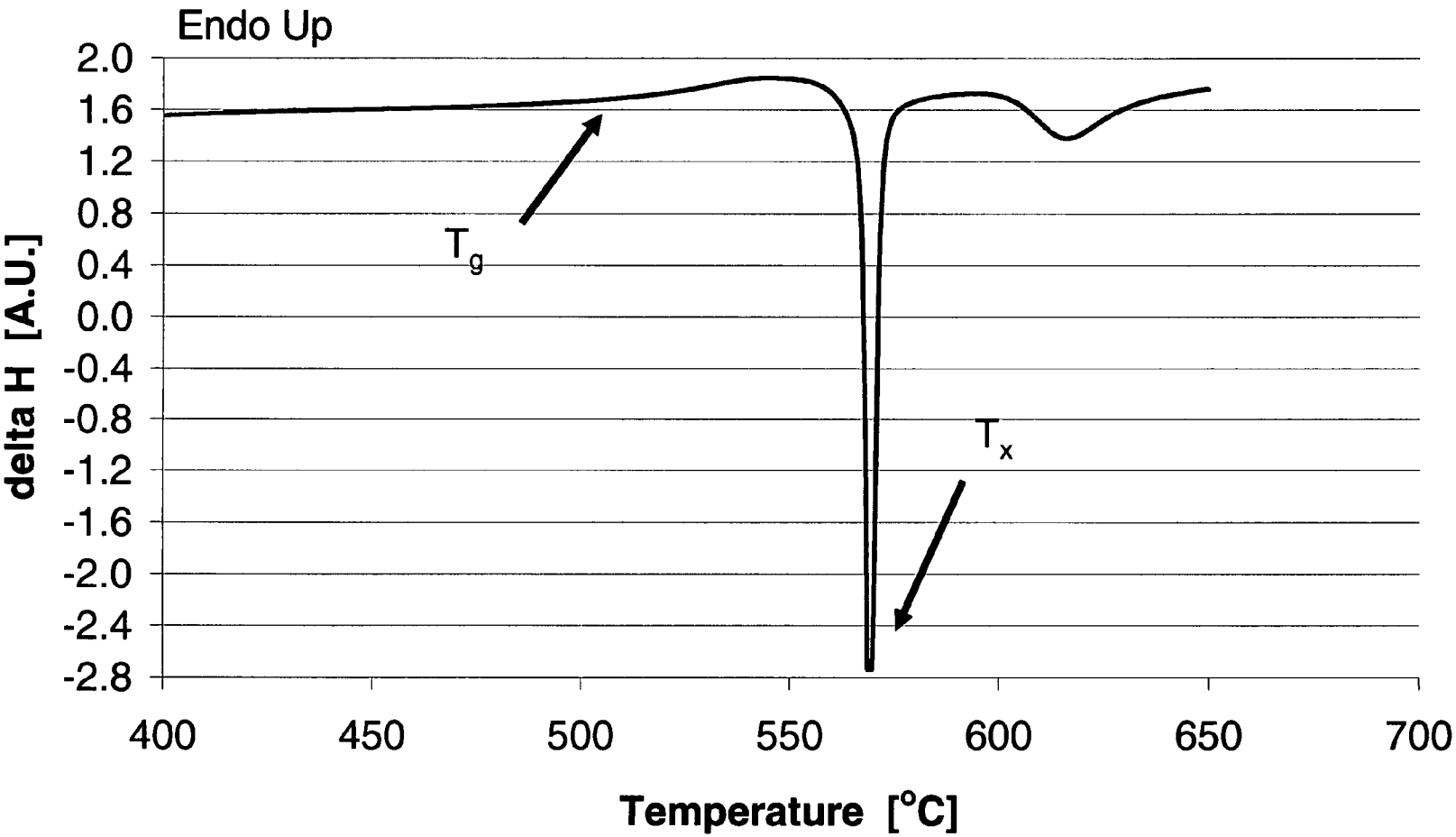
FIG. 8 is the differential thermal analysis trace for an alloy, showing the glass transition and crystallization temperatures, in accordance with a preferred embodiment of the invention.

FIG. 8 shows a differential thermal analysis trace plot of the glass transition, $T_g$, and crystallization, $T_x$, temperatures of the as-cast MGA sample. The glass transition begins at 774 K (507° C.) and is completed at 804 K (531° C.). The onset for crystallization of the glass is at 843 K (570° C.), and there is only one crystallization event for this glass. The supercooled liquid region, the difference between glass transition and crystallization temperatures, is 69 K. The reduced glass transition temperature, denoted as the ratio of glass transition to liquidus (i.e., the high-temperature endpoint of the complex melting event shown in FIG. 8) is approximately 0.59.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

We claim:

1. A Hafnium-based high-density metallic glass alloy having the ratio of elements of the formula $Hf_aCu_bNi_cAl_dY_e$ wherein;

Y is Ti or Nb;

a is less than 45 atomic percent;

b is from about 15 to about 35 atomic percent;

c is from about 5 to about 25 atomic percent;

d is from about 0 to about 20 atomic percent; and e is from about 0 to about 15 atomic percent, wherein a+b+c+d+e=100; said alloy having a density of about 10.5 g/cm3.

2. The metallic glass alloy of claim 1, wherein the alloy exhibits a distinct glass transition temperature, that is at least 0.59 of the liquidus temperature of the alloy.

3. The metallic glass alloy of claim 1, wherein the ratio of Cu to Ni is 2:1.

4. The metallic glass alloy of claim 1, having about 5 or more atomic percent Ti.

5. The metallic glass alloy of claim 1, having about 5 or more atomic percent Nb.

6. A Hafnium-based high-density metallic glass alloy composition comprising:

44.5 atomic percent hafnium;

about 27 atomic percent copper;

about 13.5 atomic percent nickel;

about 10 atomic percent aluminum; and about 5 atomic percent titanium or niobium; and a density greater than 7 g/cm$^3$.

7. The composition of claim 6, having a density of about 10.5 g/cm3 or more.

8. The composition of claim 6, wherein the composition exhibits a distinct glass transition temperature of at least 0.59 of the liquidus temperature of the composition.

9. An article comprising the metallic glass alloy of claim 6.

10. The article of claim 9 having a thickness of at least 1 millimeter in its smallest dimension.

11. The article of claim 9 having a thickness of at least 3 millimeters in its smallest dimension.

12. The article of claim 9 wherein the ratio of copper to nickel is 2:1.

13. The article of claim 9, wherein the alloy is at least partially amorphous.

14. The article of claim 9, wherein the article has an elastic strain to failure between about 1.8 and 2.2 percent elongation.

15. The article of claim 9, wherein the object has a quasi-static compressive yield stress of between about 1.8 and 2.2 GPa.

16. The article of claim 9, wherein the object has a dynamic high-strain-rate yield stress of between about 1.3 and 1.6 GPa.

17. The article of claim 9, wherein the article is formed by vacuum suction casting.

18. The article of claim 9, wherein the article is formed by permanent mold casting, injection die casting, pour casting, planar flow casting, melt spinning, or extrusion.

19. A metallic glass alloy comprising Hf, Cu, and Ni in eutectic combination with Al, Ti, Nb or a combination thereof, having a density equal to or greater than about 10.5 g/cm3.

20. A method for forming a Hafnium-based high-density metallic glass alloy comprising:

combining 44.5 atomic percent hafnium;

about 27 atomic percent copper;

about 13.5 atomic percent nickel;

about 10 atomic percent aluminum; and about 5 atomic percent titanium or niobium and heating said ingredients in an inert atmosphere to form an alloy.

21. The method of claim 20, wherein the alloy is formed by heating with electric arc melting.

22. The method of claim 20, wherein the alloy is formed by induction melting.

* * * * *